US011178740B2

(12) United States Patent
van de Ven et al.

(10) Patent No.: US 11,178,740 B2
(45) Date of Patent: Nov. 16, 2021

(54) SOLID-STATE LIGHTING APPARATUS INCLUDING CURRENT DIVERSION CONTROLLED BY LIGHTING DEVICE BIAS STATES AND CURRENT LIMITING USING A PASSIVE ELECTRICAL COMPONENT

(75) Inventors: Antony P. van de Ven, Sai Kung (HK); Liqin Ni, Morrisville, NC (US)

(73) Assignee: Ideal Industries Lighting LLC, Racine, WI (US)

( * ) Notice: Subject to any disclaimer, the term of this patent is extended or adjusted under 35 U.S.C. 154(b) by 1343 days.

(21) Appl. No.: 13/338,076

(22) Filed: Dec. 27, 2011

(65) Prior Publication Data

US 2013/0162153 A1 Jun. 27, 2013

(51) Int. Cl.
*H05B 45/50* (2020.01)
*H05B 45/48* (2020.01)

(52) U.S. Cl.
CPC ..... *H05B 45/48* (2020.01); *H05B 45/50* (2020.01)

(58) Field of Classification Search
CPC ..... H05B 45/50; H05B 45/48; H05B 45/52; H05B 45/54
USPC ..... 315/193, 291, 294, 297, 185 R
See application file for complete search history.

(56) References Cited

U.S. PATENT DOCUMENTS 4,798,983 A 1/1989 Mori
5,397,938 A 3/1995 Wilhelm et al.
5,941,626 A 8/1999 Yamuro
2004/0046510 A1 3/2004 Allen
2008/0094000 A1 4/2008 Yamamoto et al.
2010/0109570 A1* 5/2010 Weaver ..... 315/295
2010/0308738 A1* 12/2010 Shteynberg et al. ..... 315/185 R
2011/0025230 A1* 2/2011 Schulz ..... H05B 33/0818 315/294
2011/0199003 A1* 8/2011 Muguruma ..... H05B 33/083 315/122
2012/0091920 A1 4/2012 Yang
2012/0099321 A1 4/2012 Scott et al.

OTHER PUBLICATIONS

International Search Report Corresponding to International Application No. PCT/US12/71163; dated Mar. 12, 2013; 9 Pages.
Notification Concerning Transmittal of International Preliminary Report on Patentability in corresponding PCT Application No. PCT/US2012/071163 dated Jul. 10, 2014 (8 pages).

* cited by examiner

*Primary Examiner* — Dennis P Joseph
(74) *Attorney, Agent, or Firm* — Withrow & Terranova, PLLC

(57) ABSTRACT

A lighting apparatus includes a string of light emitting diode (LED) sets coupled in series where each set includes at least one LED. A current diversion circuit is coupled to the string and is configured to operate responsive to a bias state transition of one of the LED sets to direct current away from another one of the LED sets. A current limiting circuit is coupled in series with the string and is configured to conduct current responsive to a forward biasing of all of the LED sets. The current limiting circuit includes only passive electrical component(s).

34 Claims, 7 Drawing Sheets

SOLID-STATE LIGHTING APPARATUS INCLUDING CURRENT DIVERSION CONTROLLED BY LIGHTING DEVICE BIAS STATES AND CURRENT LIMITING USING A PASSIVE ELECTRICAL COMPONENT

FIELD

The present inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources, for example, in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting arrays are used for a number of lighting applications. For example, solid-state lighting panels including arrays of solid-state light emitting devices have been used as direct illumination sources, for example, in architectural and/or accent lighting. Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

A solid-state light emitting device may include, for example, a packaged light emitting device including one or more LEDs. Inorganic LEDs typically include semiconductor layers forming p-n junctions. Organic LEDs (OLEDs), which include organic light emission layers, are another type of solid-state light emitting device. Typically, a solid-state light emitting device generates light through the recombination of electronic carriers, i.e. electrons and holes, in a light emitting layer or region.

Some attempts at providing solid-state lighting sources have involved driving an LED or string or group of LEDs using a rectified alternating current (ac) waveform. However, because the LEDs require a minimum forward voltage to turn on, the LEDs may turn on for only a part of the rectified ac waveform, which may result in visible flickering, may undesirably lower the power factor of the system, and/or may increase resistive loss in the system. Examples of techniques for driving LEDs with a rectified ac waveform are described in U.S. Patent Application Publication No. 2010/0308738 and in U.S. patent application Ser. No. 12/777,842, now issued as U.S. Pat. No. 8,479,363, the latter of which is commonly assigned to the assignee of the present application.

Other attempts at providing ac-driven solid-state lighting sources have involved placing LEDs in an anti-parallel configuration, so that half of the LEDs are driven on each half-cycle of an ac waveform. However, this approach requires twice as many LEDs to produce the same luminous flux as using a rectified ac signal.

SUMMARY

According to some embodiments of the inventive subject matter, a lighting apparatus includes a string of LED sets coupled in series where each set includes at least one LED. A current diversion circuit is coupled to the string and is configured to operate responsive to a bias state transition of one of the LED sets to direct current away from another one of the LED sets. A current limiting circuit is coupled in series with the string and is configured to conduct current responsive to a forward biasing of all of the LED sets. The current limiting circuit includes only passive electrical component(s).

In other embodiments, the current diversion circuit is configured to conduct current via a first one of the LED sets and is configured to be turned off responsive to current through a second one of the LED sets.

In still other embodiments, the current diversion circuit is configured to conduct current responsive to a forward biasing of the first one of the LED sets.

In still other embodiments, the first one of the LED sets includes more LEDs than other ones of the LED sets.

In still other embodiments, the current diversion circuit is configured to turn off responsive to a voltage at a node of the string.

In still other embodiments, the lighting apparatus further includes a resistor coupled in series with the string. The first one of the current diversion circuits is configured to turn off responsive to a voltage at a terminal of the resistor.

In still other embodiments, the current diversion circuit includes a bipolar transistor providing a controllable current path between a node of the string and a terminal of a power supply. The current through the resistor varies an emitter bias of the bipolar transistor.

In still other embodiments, the current diversion circuit includes a transistor providing a controllable current path between a node of the string and a terminal of a power supply and a turn-off circuit coupled to a node of the string and to a control terminal of the transistor and configured to control the current path responsive to a control input.

In still other embodiments, current through one of the LED sets provides the control input.

In still other embodiments, the transistor is a bipolar transistor and the turn-off circuit is configured to vary a base current of the bipolar transistor responsive to the control input.

In still other embodiments, the bias states of the LED sets transition responsive to a power supply having a varying voltage such that the diversion circuit is activated in response to increases and decreases in the varying voltage.

In still other embodiments, the current diversion circuit includes a plurality of current diversion circuits, respective ones of which are coupled to respective nodes of the string and configured to operate responsive to bias state transitions of respective ones of the LED sets. A number of the plurality of current diversion circuits is less than a number of the LED sets.

In further embodiments of the present inventive subject matter, a lighting apparatus includes a rectifier circuit configured to be coupled to an ac power source and to generate a rectified ac voltage, a string of serially-connected LED sets, each set including at least one LED, a current diversion circuit coupled to the string and configured to be selectively enabled and disabled responsive to bias state transitions of the LED sets as a magnitude of the rectified ac voltage varies, and a current limiting circuit coupled in series with the string and being configured to conduct current responsive to a forward biasing of all of the LED sets. The current limiting circuit includes only passive electrical component(s).

In still further embodiments, the current diversion circuit is configured to conduct current via a first one of the LED sets and is configured to be turned off responsive to current through a second one of the LED sets.

In still further embodiments, the first one of the LED sets comprises more LEDs than other ones of the LED sets.

In still further embodiments, the current diversion circuit is configured to conduct current responsive to a forward biasing of the first one of the LED sets.

In still further embodiments, the current diversion circuit is configured to turn off responsive to a voltage at a node of the string.

In still further embodiments, the lighting apparatus further includes a resistor coupled in series with the string. The current diversion circuit is configured to turn off responsive to a voltage at a terminal of the resistor.

In still further embodiments, the lighting apparatus further includes a resistor coupled in series with the string. The current diversion circuit includes a bipolar transistor providing a controllable current path between a node of the string and a terminal of the rectifier circuit and current through the resistor varies an emitter bias of the bipolar transistor.

In still further embodiments, the current diversion circuits includes a transistor providing a controllable current path between a node of the string and a terminal of the rectifier circuit and a turn-off circuit coupled to a node of the string and to a control terminal of the transistor and configured to control the current path responsive to a control input.

In still further embodiments, a current through one of the LED sets provides the control input.

In still further embodiments, the transistor comprises a bipolar transistor and the turn-off circuit is configured to vary a base current of the bipolar transistor responsive to the control input.

In still further embodiments, the current diversion circuit includes a plurality of current diversion circuits, respective ones of which are coupled to respective nodes of the string and configured to operate responsive to bias state transitions of respective ones of the LED sets. A number of the plurality of current diversion circuits is less than a number of the LED sets.

In other embodiments of the present inventive subject matter, an apparatus includes a current diversion circuit coupled to a string of serially-connected LED sets and to operate responsive to bias state transitions of one of the LED sets to direct current away from another one of the LED sets. A current limiting circuit coupled in series with the string and being configured to conduct current responsive to a forward biasing of all of the LED sets. The current limiting circuit is comprised solely of at least one passive electrical component.

In still other embodiments, the current diversion circuit is configured to conduct current via a first one of the LED sets and is configured to be turned off responsive to current through a second one of the LED sets.

In still other embodiments, the first one of the LED sets comprises more LEDs than other ones of the LED sets.

In still other embodiments, the current diversion circuit is configured to conduct current responsive to a forward biasing of the first one of the LED sets.

In still other embodiments, the current diversion circuit is configured to turn off responsive to a voltage at a node of the string.

In still other embodiments, the current diversion circuit is configured to turn off responsive to a voltage at a terminal of a resistor coupled in series with the string.

In still other embodiments, the current diversion circuit includes a bipolar transistor providing a controllable current path between a node of the string and a terminal of a power supply and current through a resistor coupled in series with the string varies an emitter bias of the bipolar transistor.

In still other embodiments, the current diversion circuit comprises a transistor configured to provide a controllable current path between a node of the string and a terminal of a power supply and a turn-off circuit coupled to a node of the string and to a control terminal of the transistor and configured to control the current path responsive to a control input.

In still other embodiments, current through one of the LED sets provides the control input.

In still other embodiments, the apparatus further includes a rectifier circuit configured to be coupled to a power source and having an output configured to be coupled to the string of LED sets.

In still other embodiments, the current diversion circuit includes a plurality of current diversion circuits, respective ones of which are coupled to respective nodes of the string and configured to operate responsive to bias state transitions of respective ones of the LED sets. A number of the plurality of current diversion circuits is less than a number of the LED sets.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
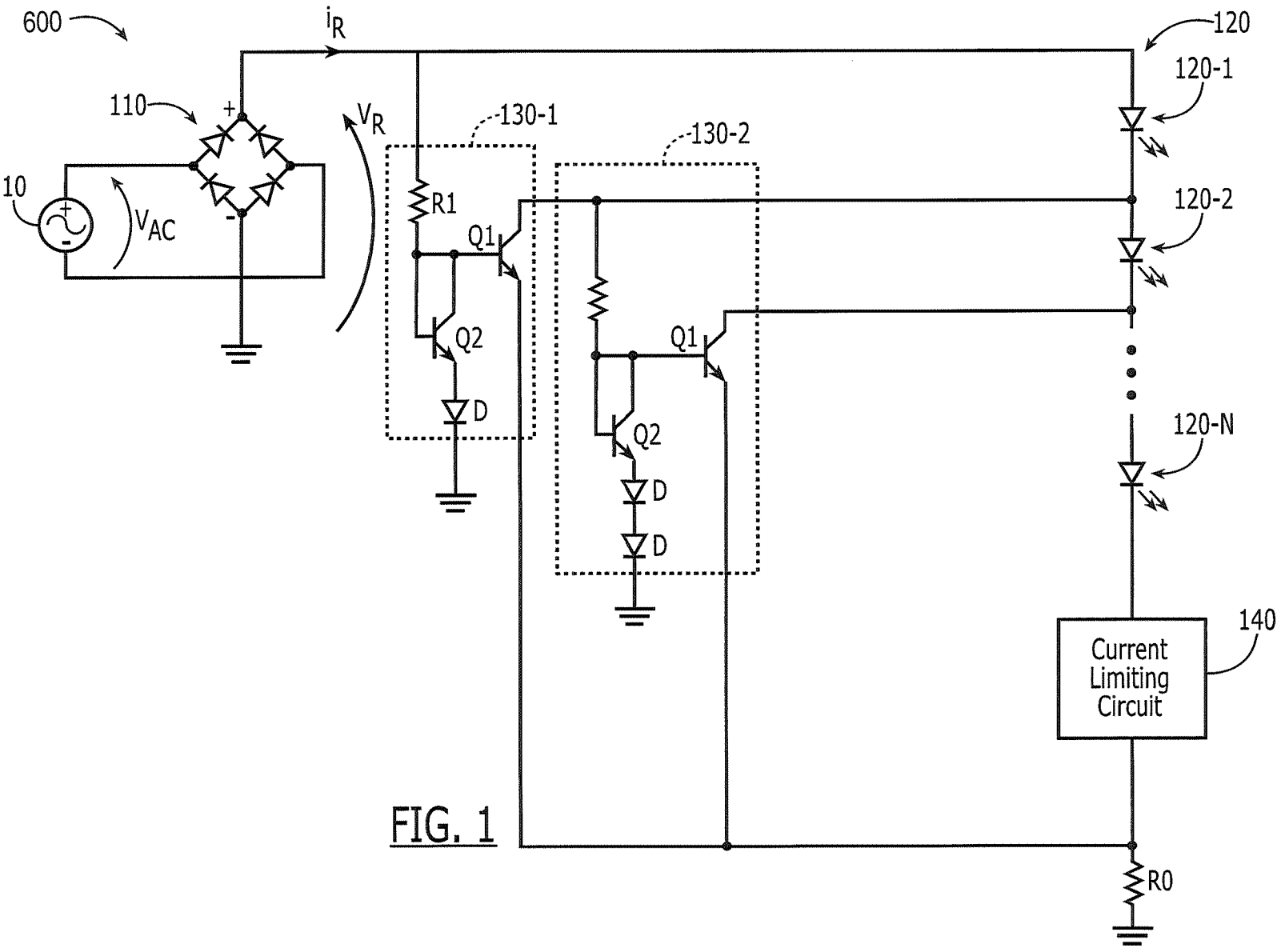
FIG. 1 illustrates a lighting apparatus according to some embodiments of the inventive subject matter.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout the description. Each embodiment described herein also includes its complementary conductivity embodiment.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus," as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing ac incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly).

As used herein, "passive electrical component" means a component that is not capable of power gain. Such components may include, but are not limited to, capacitors, inductors, resistors, diodes, voltage sources, and current sources. An "active electrical component" means a component that is capable of power gain.

According to some embodiments of the inventive subject matter, a string of solid state lighting device sets, e.g., sets of LEDs, may be incrementally activated and deactivated responsive to a bias states of the device sets. In some embodiments, for example, one or more current diversion circuits may be activated and deactivated responsive to the forward biasing of LED sets in a string as a rectified power supply voltage is applied to the string. The current diversion circuits may include, for example, respective transistors that are configured to provide respective controllable current diversion paths. These transistors may be turned on and off by bias transitions of the LED sets, which may be used to effect biasing of the transistors. Such circuitry may be relatively simple in comparison to circuitry that uses comparators or the like to control activation of LED sets in a string. A current limiting circuit is coupled in series with the string of LED sets and is configured to conduct current responsive only to a forward biasing of all of the LED sets. The current limiting circuit is comprised solely of one or more passive electronic components. In some embodiments, the current limiting circuit may comprise a resistor.

FIG. 1 illustrates a lighting apparatus 100 according to some embodiments of the inventive subject matter. The apparatus 100 comprises a string 120 of serially connected LED sets 120-1, 120-2, . . . , 120-N. Each of the LED sets 120-1, 120-2, . . . , 120-N includes at least one LED. For example, individual ones of the sets may comprise a single LED and/or individual sets may include multiple LEDs connected in various parallel and/or serial arrangements. Power is provided to the LED string 120 from a rectifier circuit 110 that is configured to be coupled to an ac power source 10 and to produce a rectified voltage $V_R$ and current $i_R$ therefrom. The rectifier circuit 110 may be included in the lighting apparatus 100 or may be part of a separate unit coupled to the apparatus 100.

The apparatus 100 further comprises respective current diversion circuits 130-1 and 130-2 connected to respective nodes of the string 120. The current diversion circuits 130-1 and 130-2 are configured to provide current paths that, in the illustrated embodiments, bypass respective groups of the LED sets 120-1 and 120-2. The current diversion circuits 130-1 and 130-2 each include a transistor Q1 that is configured to provide a controlled current path that may be used to selectively bypass the LED sets 120-2, . . . , 120-N. The transistors Q1 are biased using transistors Q2, resistors R1 and R2 and diodes D. The transistors Q2 are configured to operate as diodes, with their base and collector terminals connected to one another. Differing numbers of diodes D are connected in series with the transistors Q2 in respective ones of the current diversion circuits 130-1 and 130-2 such that the base terminals of current path transistors Q1 in the respective current diversion circuits 130-1 and 130-2 are biased at different voltage levels. Resistors R1 and R2 serve to limit base currents for the current path transistors Q1.

The current path transistors Q1 of the respective current diversion circuits 130-1 and 130-2 will turn off at different emitter bias voltages, which are determined by a current flowing through a resistor R0. Accordingly, the current diversion circuits 130-1 and 130-2 are configured to operate in response to bias state transitions of the LED sets 120-1, 120-2, . . . , 120-N as the rectified voltage $V_R$ increases and decreases such that the LED sets 120-1, 120-2, . . . , 120-N are incrementally activated and deactivated as the rectified voltage $V_R$ rises and falls. The current path transistors Q1 are turned on and off as bias states of the LED sets 120-1, 120-2, . . . , 120-N change. Lighting apparatus that include current diversion circuits controlled by lighting device bias states are described, for example, in U.S. patent application Ser. No. 13/235,127 filed Sep. 16, 2011 and issued as U.S. Pat. No. 9,277,605, which is hereby incorporated herein by reference in its entirety.

Rather than associate a current diversion circuit 130 with the final LED set 120-N, a current limiting circuit 140 is placed in series with the string of LED sets 120 such that the current limiting circuit conducts current once all of the LED sets 120-1, 120-2, . . . , 120-N in the string 120 are in a forward bias state. The current limiting circuit 140 may comprise one or more passive electrical components configured to generate a desired impedance that limits the current flowing through the LED string 120 to a desired level. For example, in some embodiments, the current limiting circuit 140 may comprise a resistor.

Figure 2:
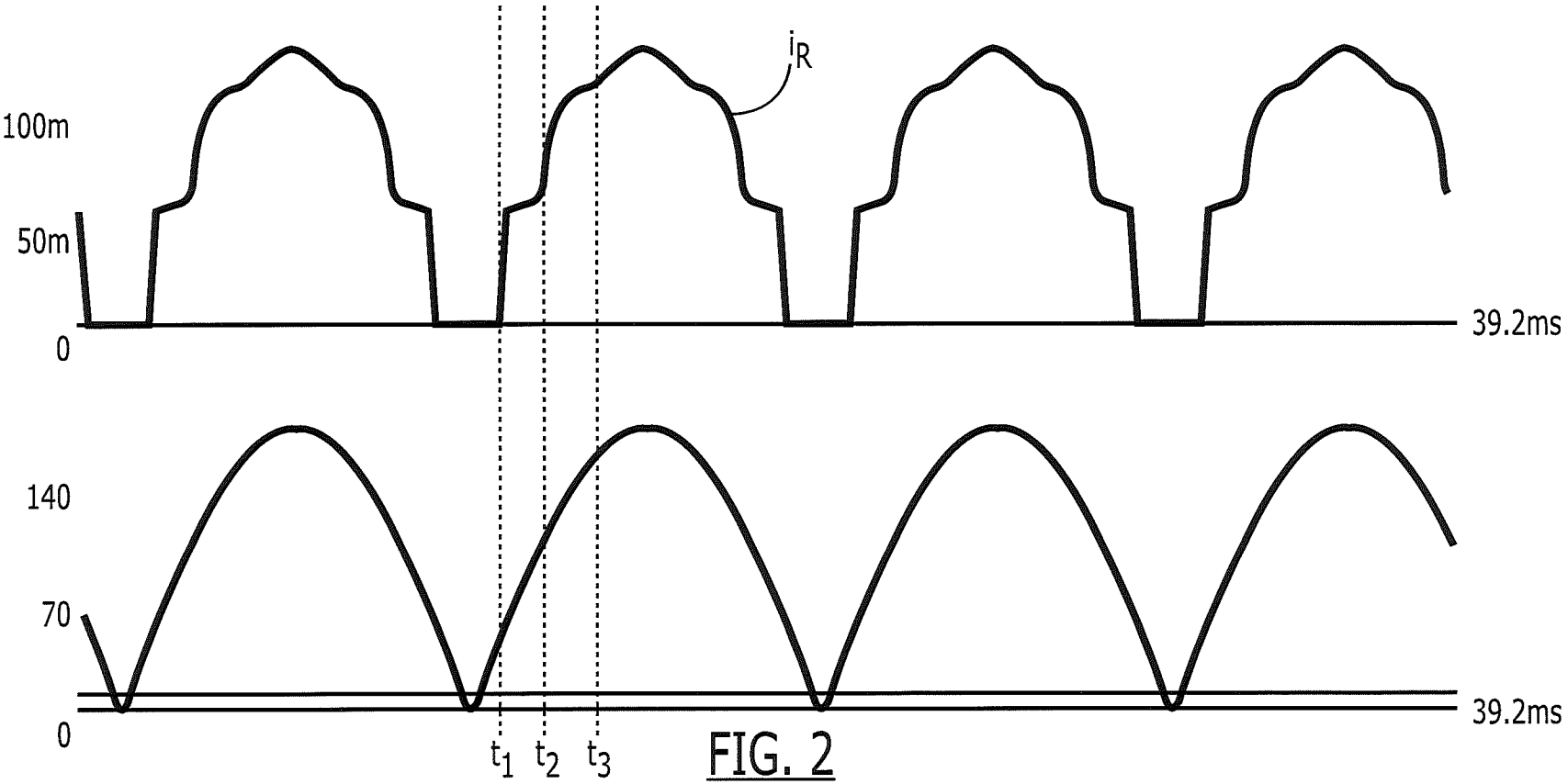
FIG. 2 illustrates current and voltage waveforms for the lighting apparatus of FIG. 1.

FIG. 2 illustrates current and voltage waveforms for an implementation using three LED sets (N=3) using the structure of the apparatus 100 of FIG. 1. Referring to FIG. 1 in conjunction with FIG. 2, when the rectified voltage $V_R$ increases to a level sufficient to forward bias the first LED set 120-1, the transistor Q1 turns on and the current begins to flow through the first LED set 120-1 at around a time t1, causing it to begin emitting light. Current passes through the first LED set 120-1, through the first current diversion circuit 130-1, and through the resistor R0, bypassing the other LED sets in the string 120.

As the rectified voltage $V_R$ continues to increase to a level sufficient to forward bias the second LED set 120-2, the transistor Q1 of the second current diversion circuit 130-2 turns on at around a time t2, allowing current to flow through the first and second LED sets 120-1, 120-2. The resulting increase in current flow through the resistor R0 results in an increase in a voltage across the resistor R0 that causes the base-emitter junction of the current path transistor Q1 of the first current diversion circuit 130-1 to become reversed bias, thus interrupting flow through the first current diversion circuit 130-1. As a result, the bulk of the current flowing through the first and second LED sets 120-1, 120-2 begins to pass through the second current diversion circuit 130-2. As the rectified voltage $V_R$ further increases, a similar transition occurs such that the third LED set 120-N becomes forward biased and current flows through the current limiting circuit 140 at around a time t3, and the second current diversion circuit 130-2 is turned off. After the rectified voltage $V_R$ peaks and begins to decrease, a reverse series of transitions occurs, such that the third LED set 120-N, the second LED set 120-2 and the first LED set 120-1 are sequentially deactivated. As can be seen in FIG. 2, this results in a rectified current $i_R$ that approximately tracks the rectified voltage $V_R$ in a step-wise manner.

Circuitry along the lines illustrated in FIG. 1 can provide several potential advantages. For example, operating the current diversion circuits 130-1 and 130-2 responsive to biasing of the LED sets 120-1, 120-2, . . . , 120-N can eliminate the need to use relatively complex comparator circuits that monitor current and/or voltage through the LED string 120 to control bypassing of the LED sets, Relatively simple and inexpensive components may be used for the current diversion circuits 130-1 and 130-2, and these components may be relatively easily integrated with the LEDs. For example, the current diversion circuitry (and, optionally, the rectifier circuitry) may be integrated with the LEDs on a common substrate or in an integrated lighting module. Moreover, by using a current limiting circuit 140 in place of for a last subset of LEDs to be activated the active components associated with a current diversion circuit may be replaced by one or more passive components, such as a resistor, further reducing the cost of the lighting apparatus while maintaining acceptable performance with respect to power factor and total harmonic distortion metrics.

Figure 3:
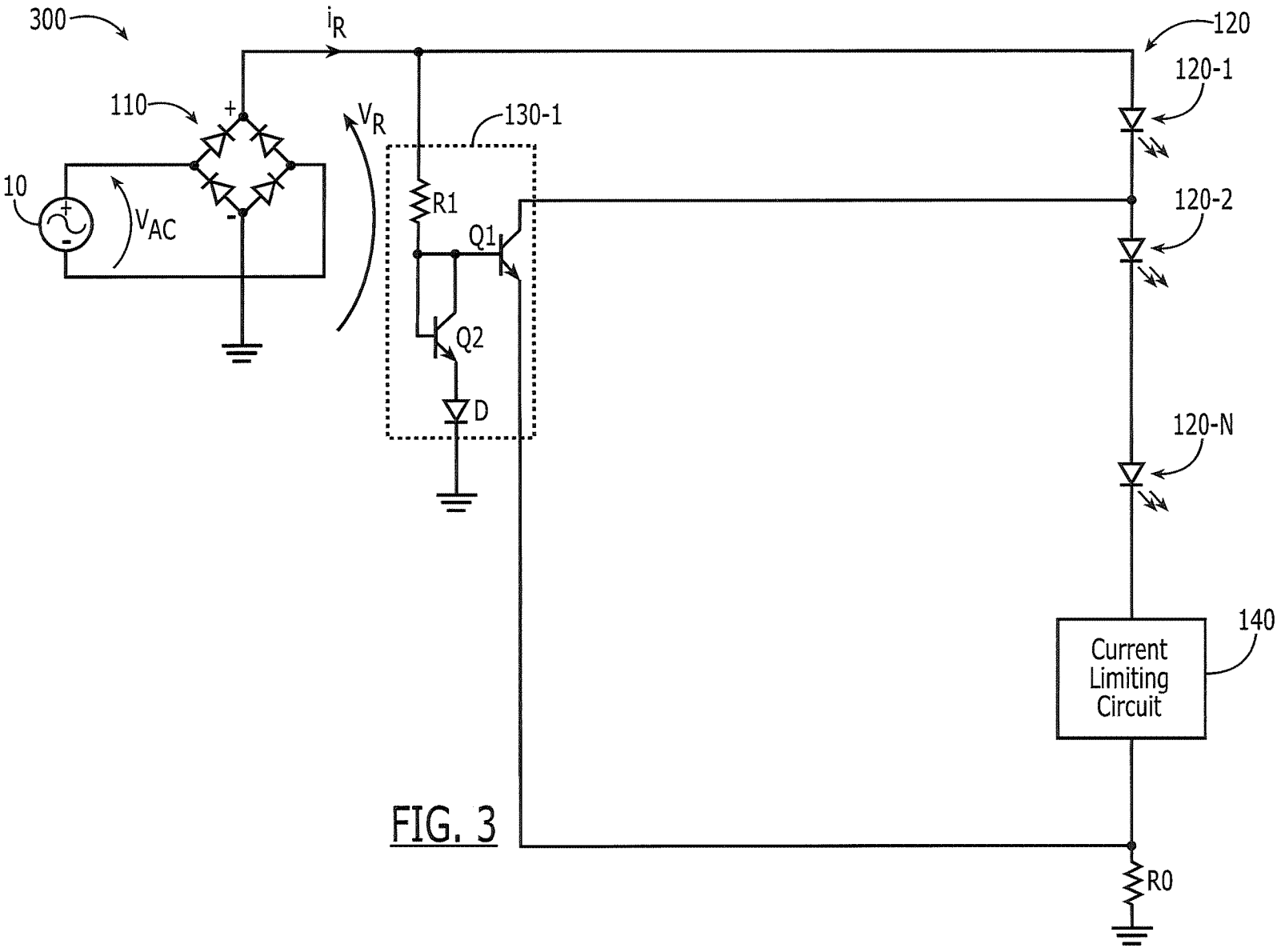
FIG. 3 illustrates a lighting apparatus according to further embodiments of the inventive subject matter.

FIG. 3 illustrates a lighting apparatus 300 according to further embodiments of the present inventive subject matter. The lighting apparatus 300 is similar to the lighting apparatus 100 of FIG. 1, but does not include the current diversion circuit 130-2. Similar to the apparatus of FIG. 1, as a rectified voltage produced by a rectifier 110 increases, the current diversion circuit 130-1 turns on, providing a current path for a first LED set 120-1 such that the first LED set 120-1 illuminates. As the rectified voltage further increases, the remainder of the LED sets 120-2 through 120-N become forward biased and the increased current through the resistor R0 by way of the current limiting circuit 140 turns off the first current diversion circuit 130-1. After the rectified voltage peaks and starts to decline as described above, the LED sets 120-1 and 120-2, . . . , 120-N are sequentially turned off in the reverse order that they were turned on.

Figure 4:
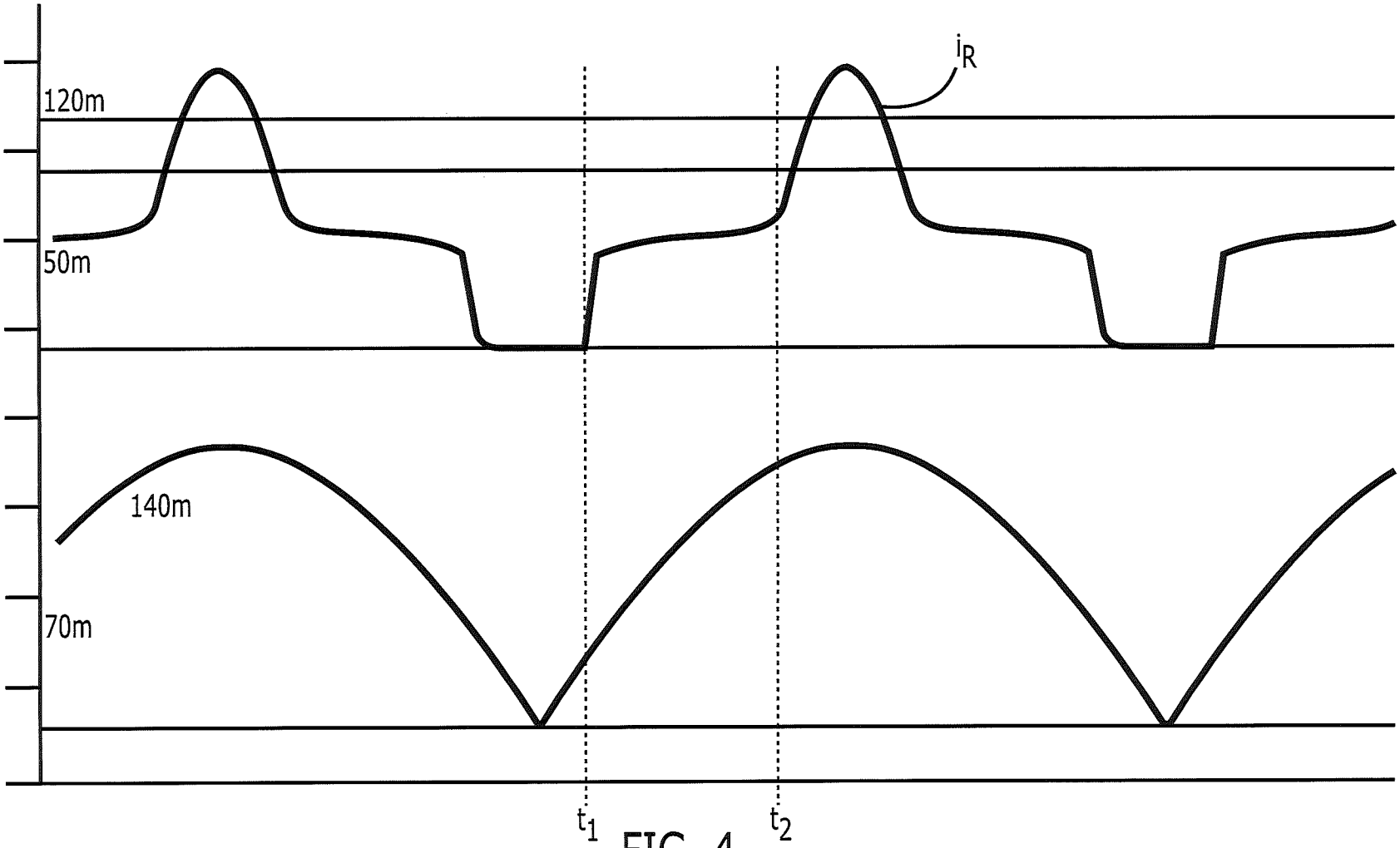
FIG. 4 illustrates current and voltage waveforms for the lighting apparatus of FIG. 3.

FIG. 4 illustrates current and voltage waveforms for an implementation using two LED sets (N=2) using the structure of the apparatus 300 of FIG. 3. Referring to FIG. 3 in conjunction with FIG. 4, when the rectified voltage $V_R$ increases to a level sufficient to forward bias the first LED set 120-1, the transistor Q1 turns on and the current begins to flow through the first LED set 120-1 at around a time t1, causing it to begin emitting light. Current passes through the first LED set 120-1, through the current diversion circuit 130-1, and through the resistor R0, bypassing the other LED sets in the string 120.

As the rectified voltage $V_R$ continues to increase to a level sufficient to forward bias the second LED set, which includes LED set 120-2 through LED set 120-N, current flows through the current limiting circuit 140 at around a time t2, and the current diversion circuit 130-1 is turned off. After the rectified voltage $V_R$ peaks and begins to decrease, a reverse series of transitions occurs, such that the second LED set 120-2 through 120-N and the first LED set 120-1 are sequentially deactivated. As can be seen in FIG. 4, this results in a rectified current $i_R$ that approximately tracks the rectified voltage $V_R$ in a step-wise manner.

The lighting apparatus of FIG. 3 turns on all LED sets in an LED string 120 in a two step process with a first subset of the LED sets being turned on initially and the remainder being turned on in a second step. The number of steps used in an activation sequence may be based on factors such as perceptible flicker, power factor, and efficiency. For example, in the lighting apparatus of FIG. 3, it may be desirable to place more LEDs in the first LED set 120-1 than are included in other ones of the LED sets. That is, because LED sets 120-2 through 120-N may be viewed as a single LED set in FIG. 3, the number of LEDs in the first LED set 120-1 may exceed the number of LEDs in sets 120-2 through 120-N. This may reduce the power consumed by the lighting apparatus as there is less power drawn during the lower portion of the rectified voltage $V_R$ cycle.

Figure 5:
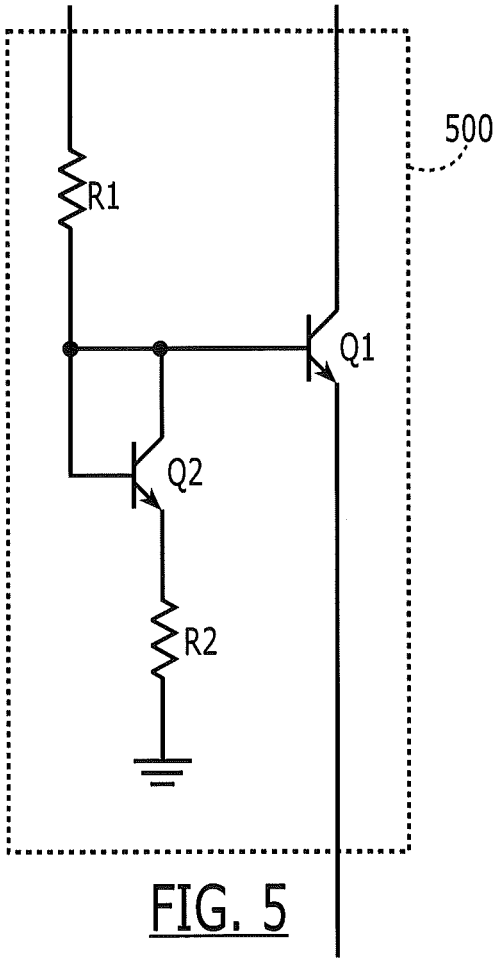
FIG. 5 illustrates a current diversion circuit according to further embodiments of the inventive subject matter.

According to further embodiments of the inventive subject matter, current diversion circuits may utilize use voltage dividers instead of diodes to bias current path transistors. For example, as shown in FIG. 5, a current diversion circuit 500 may include a current path transistor Q1, biased with a network including a diode-connected transistor Q2 and resistors R1, R2. In a lighting apparatus in which multiple ones of such current diversion circuits are used along the lines of the apparatus 100 and 300 of FIGS. 1 and 3, for example, the resistors R1, R2 are chosen to provide different base bias voltages for respective ones of the current diversion circuits. It will be understood that embodiments of the present inventive subject matter are not limited to specific type of electrical components used in biasing the current path transistor Q1. For example, diode(s) may be used as shown in FIGS. 1 and 3, resistor(s) may be used as shown in FIG. 5, and/or Zener diodes may be used.

Figure 6:
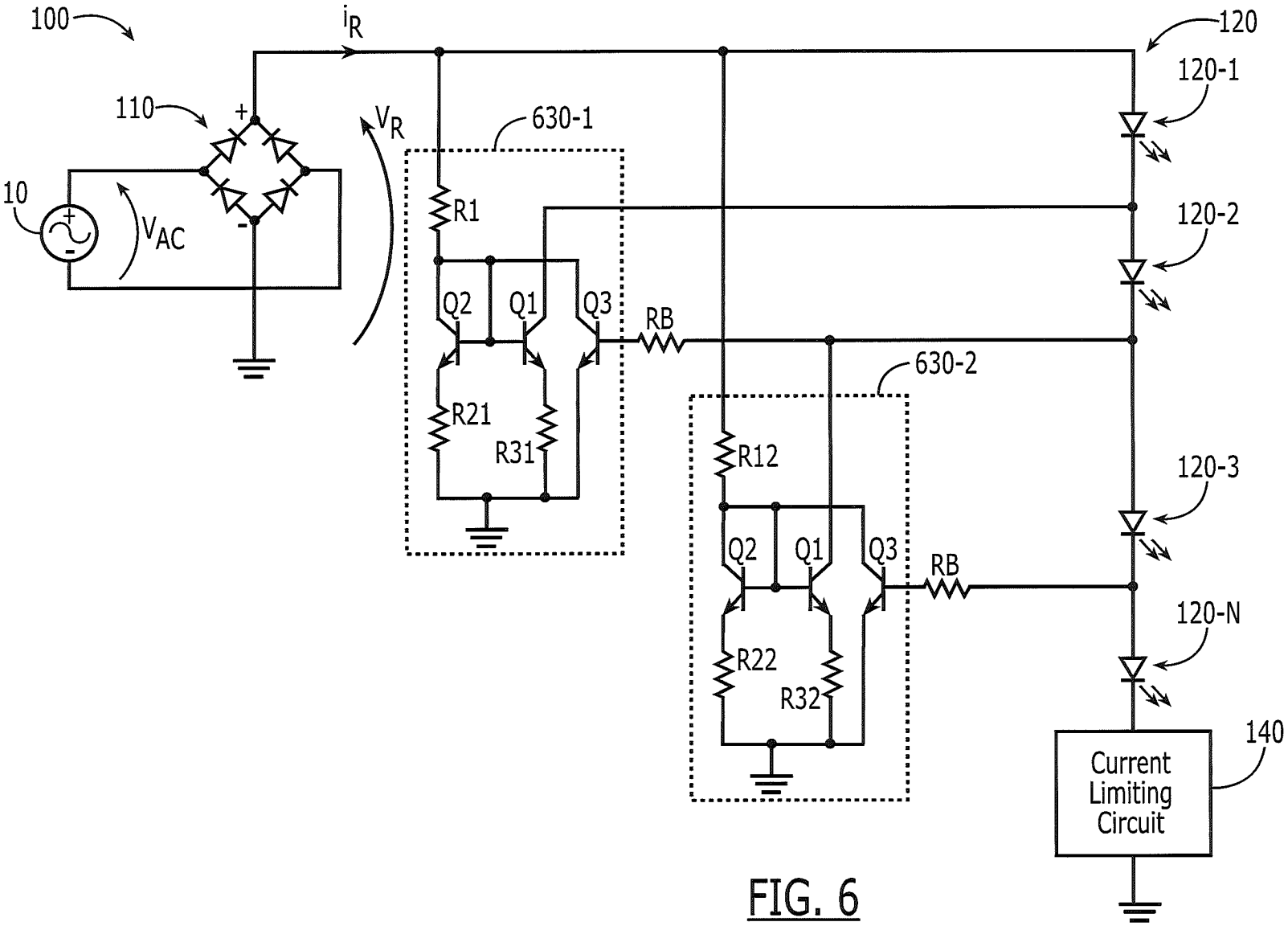
FIG. 6 illustrates a lighting apparatus according to further embodiments of the inventive subject matter.

In further embodiments of the present inventive subject matter, current arising from a bias state transition of an LED set may be used to disable a current path transistor in a modification of the approach described above with reference to FIGS. 1 and 3. FIG. 6 illustrates a lighting apparatus 600 that comprises a string 120 of serially connected LED sets 120-1, 120-2, . . . , 120-N. Each of the LED sets 120-1, 120-2, . . . , 120-N includes at least one LED, and may include various parallel and/or serial arrangements of LEDs. Power is provided to the LED string 120 from a rectifier circuit 110 that is configured to be coupled to an ac power source 10 and to produce a rectified voltage $V_R$ and current $i_R$ therefrom.

Respective current diversion circuits 630-1 and 630-2 are connected to respective nodes of the string 120, and are configured to provide current paths that bypass respective groups of the LED sets 120-2 and 120-3, . . . , 120-N. The current diversion circuits 630-1 and 630-2 each include a transistor Q1 that is configured to provide a controlled current path that may be used to selectively bypass the LED sets 120-2 and 120-3, . . . , 120-N. The transistors Q1 are biased using transistors Q2 and resistors R11, R12, R21, and R22. The resistors R11, R12, R21, and R22 provide different base bias voltages for the current path transistors Q1. Resistors R31 and R32 serve as current limiters. The current diversion circuits 630-1 and 630-2 further include turn-off transistors Q3, which are used to turn off the current path transistors Q1 responsive to base currents received from nodes of the string 120 via current limiting resistors RB.

The current diversion circuits 830-1 and 830-2 are configured to operate in response to bias state transitions of the LED sets 120-1, 120-2, . . . , 120-N as the rectified voltage $V_R$ increases and decreases, such that the LED sets 120-1, 120-2, . . . , 120-N are incrementally activated and deactivated as the rectified voltage $V_R$ rises and falls. The transistors Q1 are turned on and off as bias states of the LED sets 120-1, 120-2, . . . , 120-N change. Rather than associate a current diversion circuit 130 with the final LED set 120-N, a current limiting circuit 140 is placed in series with the string of LED sets 120 such that the current limiting circuit conducts current once all of the LED sets 120-1, 120-2, . . . , 120-N in the string 120 are in a forward bias state. The current limiting circuit 140 may comprise one or more passive electrical components configured to generate a desired impedance that limits the current flowing through the LED string 120 to a desired level. For example, in some embodiments, the current limiting circuit 140 may comprise a resistor.

Current control circuits as described herein may be implemented in a number of different ways in accordance with various embodiments of the inventive subject matter. For example, a rectifier circuit, current diversion circuitry, current limiting circuitry, and LEDs as illustrated, for example, in the embodiments of FIGS. 1, 3, and 6, may be integrated in a common unit configured to be coupled to an ac power source. Such an integrated unit may take the form, for example, of a lighting fixture, a screw-in or plug in replacement for a conventional incandescent or compact fluorescent lamp, an integrated circuit or module configured to be used in a lighting fixture or lamp or a variety of other form factors. In some embodiments, portions of the current diversion circuitry and/or current limiting circuitry may be integrated with the LEDs using composite semiconductor structures, e.g., the current diversion transistors Q1 illustrated in FIGS. 1, 3, and 6 may integrated with the respective LEDs that they control to provide multi-terminal controllable LED devices configured for use in arrangements along the lines illustrated in these figures.

Figure 7:
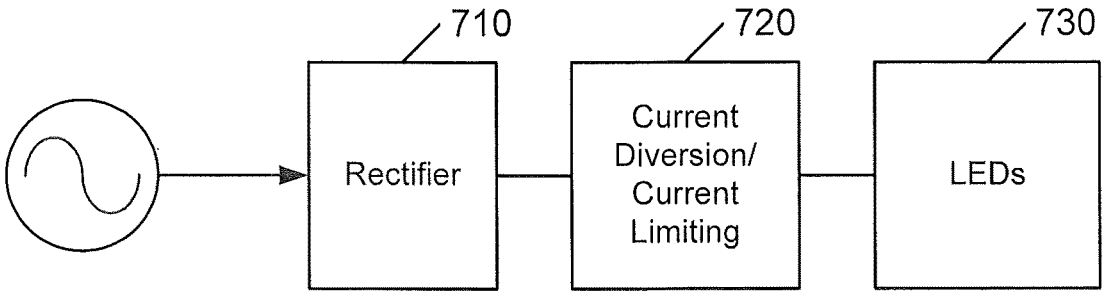
FIGS. 7-10 illustrate various arrangements of lighting apparatus components according to some embodiments of the inventive subject matter.
Figure 8:
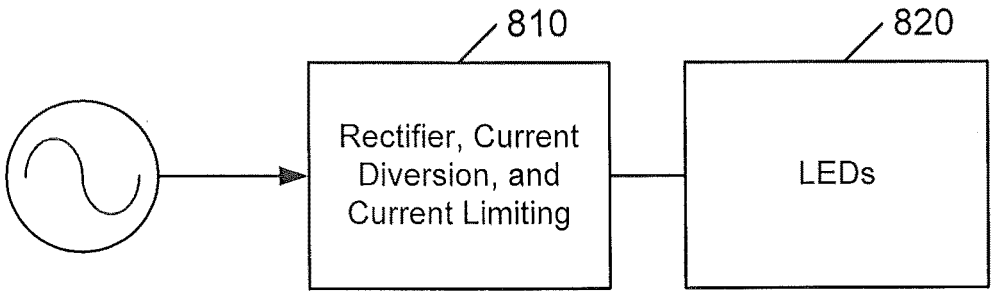
Figure 9:
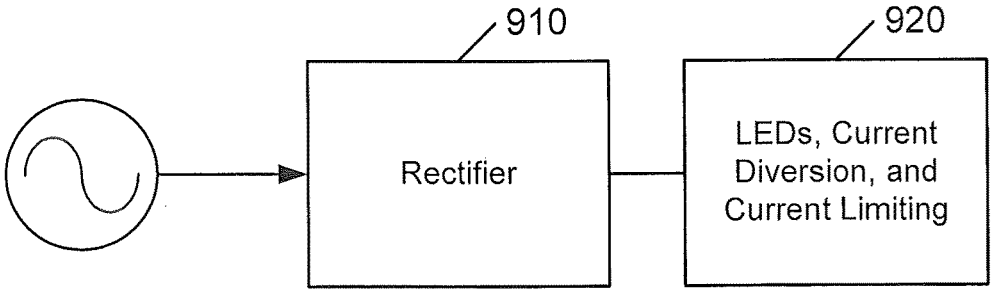
Figure 10:
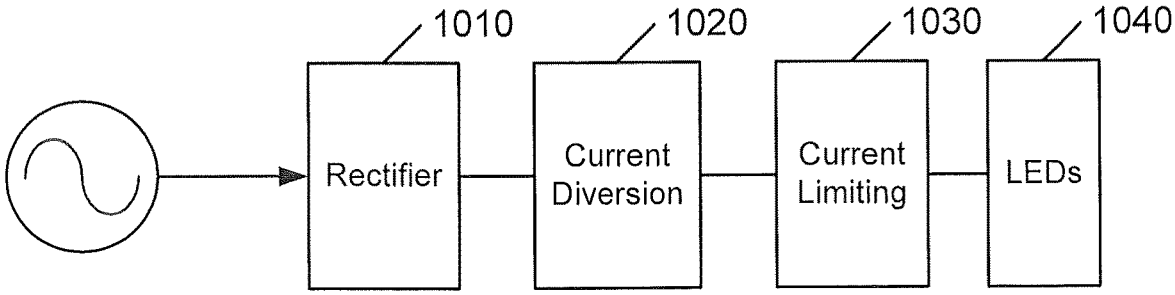

In some embodiments, such as shown in FIG. 7, a rectifier circuit, current diversion circuitry/current limiting circuitry, and LEDs may be implemented as separate units 710, 720, 730 configured to be connected to an ac power source 10 and interconnected, for example, by wiring, connectors and/or printed circuit conductors. In further embodiments, as shown in FIG. 8, a rectifier, current diversion circuitry, and current limiting circuitry may be integrated in a common unit 810, e.g., in a common microelectronic substrate, thick film assembly, circuit card, module or the like, configured to be connected to an ac power source 10 and to LEDs 820. As shown in FIG. 9, LEDs, current diversion circuitry, and current limiting circuitry may be similarly integrated in a common unit 920 that is configured to be coupled to a rectifier unit 910. In still other embodiments, a rectifier unit, current diversion circuitry, current limiting circuitry, and LEDs may be implemented as separate units 1010, 1020, 1030, and 1040 as shown in FIG. 10.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

That which is claimed:

1. A lighting apparatus, comprising:

a string of light emitting diode (LED) sets coupled in series, each LED set comprising at least one LED;

a current limiting circuit directly coupled in series with the string and being configured to conduct current responsive to a forward biasing of all of the LED sets and to otherwise be non-conducting of current;

a current diversion circuit coupled to the string and configured to operate responsive to a bias state transition of a first one of the LED sets to direct current away from a second one of the LED sets and the current limiting circuit, the current diversion circuit being connected in parallel to the second one of the LEDD, sets and the current limiting circuit, which are connected in series; and wherein the current limiting circuit is comprised of a resistor without including any active electrical component.

2. The lighting apparatus of claim 1, wherein the current diversion circuit is configured to conduct current via the first one of the LED sets and is configured to be turned off responsive to current through the second one of the LED sets.

3. The lighting apparatus of claim 2, wherein the current diversion circuit is configured to conduct current responsive to a forward biasing of the first one of the LED sets.

4. The lighting apparatus of claim 2, wherein the first one of the LED sets comprises more LEDs than other ones of the LED sets.

5. The lighting apparatus of claim 1, wherein the current diversion circuit is configured to turn off responsive to a voltage at a node of the string.

6. The lighting apparatus of claim 5, further comprising a resistor coupled in series with the string and wherein the first one of the current diversion circuits is configured to turn off responsive to a voltage at a terminal of the resistor.

7. The lighting apparatus of claim 6, wherein the current diversion circuit comprises a bipolar transistor providing a controllable current path between a node of the string and a terminal of a power supply, and wherein current through the resistor varies an emitter bias of the bipolar transistor.

8. The lighting apparatus of claim 1, wherein the current diversion circuit comprises:

a transistor providing a controllable current path between a node of the string and a terminal of a power supply; and a turn-off circuit coupled to a node of the string and to a control terminal of the transistor and configured to control the current path responsive to a control input.

9. The lighting apparatus of claim 8, wherein current through the first one of the LED sets provides the control input.

10. The lighting apparatus of claim 8, wherein the transistor comprises a bipolar transistor and wherein the turn-off circuit is configured to vary a base current of the bipolar transistor responsive to the control input.

11. The lighting apparatus of claim 1, wherein the bias states of the LED sets transition responsive to a power supply having a varying voltage such that the current diversion circuit is activated in response, to increases and decreases in the varying voltage.

12. The lighting apparatus of claim 1, wherein the current diversion circuit comprises a plurality of current diversion circuits, respective ones of which are coupled to respective nodes of the string and configured to operate responsive to bias state transitions of respective ones of the LED sets;

wherein a number of the plurality of current diversion circuits is less than a number of the LED sets.

13. A lighting apparatus comprising:

a rectifier circuit configured to be coupled to an alternating current (ac) power source and to generate a rectified ac voltage;

a string of serially-connected LED sets, each set comprising at least one LED;

a current limiting circuit directly coupled in series with the string and being configured to conduct current responsive to a forward biasing of all of the LED sets and to otherwise be non-conducting of current;

a current diversion circuit coupled to the string and configured to be selectively enabled to direct current away from the current limiting circuit and disabled responsive to bias state transitions of the LED sets as a magnitude of the rectified ac voltage varies, the current diversion circuit being connected in parallel to one of the LED sets and the current limiting circuit, which are connected in series; and wherein the current limiting circuit is comprised of a resistor without including any active electrical component.

14. The lighting apparatus of claim 13, wherein the current diversion circuit is configured to, conduct current via a first one of the LED sets and is configured to be turned off responsive to current through a second one of the LED sets.

15. The lighting apparatus of claim 14, wherein the first one of the LED sets comprises more LEDs than other ones of the LED sets.

16. The lighting apparatus of claim 14, wherein the current diversion circuit is configured to conduct current responsive to a forward biasing of the first one of the LED sets.

17. The lighting apparatus of claim 13, wherein the current diversion circuit is configured to turn off responsive to a voltage at a node of the string.

18. The lighting apparatus of claim 17, farther comprising a resistor coupled in series with the string and wherein the current diversion circuit is configured to turn of responsive to a voltage at a terminal of the resistor.

19. The lighting apparatus of claim 13, further comprising a resistor coupled in series with the string, wherein the current diversion circuit comprises a bipolar transistor providing a controllable current path between a node of the string and a terminal of the rectifier circuit and wherein current through the resistor varies an emitter bias of the bipolar transistor.

20. The lighting apparatus of claim 13, wherein the current diversion circuit comprises:

a transistor providing a controllable current path between a node of the string and a terminal, of the rectifier circuit; and a turn-off circuit coupled to a node of the string and to a control terminal of the transistor and configured to control the current path responsive to a control input.

21. The lighting apparatus of claim 20, wherein a current through one of the LED sets provides the control input.

22. The lighting apparatus of claim 20, wherein the transistor comprises a bipolar transistor and wherein the turn-off circuit is configured to vary a base current of the bipolar transistor responsive to the control input.

23. The lighting apparatus of claim 13, wherein the current diversion circuit comprises a plurality of current diversion circuits, respective ones of which are coupled to respective nodes of the string and configured to operate responsive to bias state transitions of respective ones of the LED sets;

wherein a number of the plurality of current diversion circuits is less than a number of the LET) sets.

24. An apparatus comprising a string of serially-connected light emitting diode (LED) sets;

a current limiting circuit directly coupled in series with the string and being configured to conduct current responsive to a forward biasing of all of the LED sets and to otherwise be non-conducting of current;

a current diversion circuit coupled to the string of LED sets and configured to operate responsive to bias state transitions of a first one of the LED sets to direct current away from a second one of the LED sets and the current limiting circuit, the current diversion circuit being connected in parallel to the second one of the LED sets and the current limiting circuit, which are connected in series; and wherein the current limiting circuit is comprised of a resistor without including any active electrical component.

25. The apparatus of claim 24, wherein the current diversion circuit is configured to conduct current via the first one of the LED sets and is configured to be turned off responsive to current through the second one of the LED sets.

26. The apparatus of claim 25, wherein the first one of the LED sets comprises more LEDs than other ones of the LED sets.

27. The apparatus of claim 25, wherein the current diversion circuit is configured to conduct current responsive to a forward biasing of the first one of the LED sets.

28. The apparatus of claim 24, wherein the current diversion circuit is configured to turn off responsive to a voltage at a node of the string.

29. The apparatus of claim 28, wherein the current diversion circuit is configured to turn off responsive to a voltage at a terminal of a resistor coupled in series with the string.

30. The apparatus of claim 24, wherein the current diversion circuit comprises a bipolar transistor providing a controllable current path between a node of the string and a terminal of a power supply and wherein current through a resistor coupled in series with the string varies an emitter bias of the bipolar transistor.

31. The apparatus of claim 24, wherein the current diversion circuit comprises:

a transistor configured to provide a controllable current path between anode of the string and a terminal of a power supply; and a turn-off circuit coupled to a node of the string and to a control terminal of the transistor and configured to control the current path responsive to a control input.

32. The apparatus of claim 31, wherein current through the first one of the LED sets provides the control input.

33. The apparatus of claim 24, further comprising a rectifier circuit configured to be coupled to a power source and having an output configured to be coupled to the string of LED sets.

34. The apparatus of claim 24, wherein the current diversion circuit comprises a plurality of current diversion circuits, respective ones of which are coupled to respective nodes of the string and configured to operate responsive to bias state transitions of respective ones of the LED sets;

wherein a number of the plurality of current diversion circuits is less than a number of the LED sets.

* * * * *